United States Patent [19]

Clopton

[11] Patent Number: 4,788,997

[45] Date of Patent: Dec. 6, 1988

[54] PORTABLE BLIND

[76] Inventor: Lancelot M. Clopton, Rte. 8, Box 493, Leander, Tex. 78641

[21] Appl. No.: 936,637

[22] Filed: Dec. 1, 1986

[51] Int. Cl.[4] ..... E04H 15/58; E04H 15/20; A47C 7/10

[52] U.S. Cl. ..... 135/117; 135/901; 135/108; 297/184; 297/217

[58] Field of Search ..... 135/900, 901, 106, 107, 135/108, 95, 98, DIG. 9, 117, 90, 111, 112; 297/184, 217, 488, 487, 186, 135; 43/1, 2

[56] References Cited

U.S. PATENT DOCUMENTS

| | | | |
|---|---|---|---|
| 382,493 | 5/1888 | Smith | 135/106 |
| 2,511,452 | 6/1950 | Anderson et al. | 297/184 X |
| 2,810,430 | 10/1957 | Jacob | 297/184 |
| 3,018,857 | 1/1962 | Parham | 135/901 X |
| 3,116,808 | 1/1964 | Riley | 135/90 X |
| 3,768,860 | 10/1973 | Barker | 297/184 |
| 3,799,608 | 3/1974 | Smutny et al. | 135/901 X |
| 3,902,264 | 9/1975 | Radig | 135/901 X |
| 4,106,145 | 8/1978 | Gillen et al. | 135/901 X |
| 4,364,193 | 12/1982 | Visco | 43/1 |
| 4,506,466 | 3/1985 | Hall | 297/135 X |
| 4,597,402 | 7/1986 | Morris, Jr. | 135/111 X |

FOREIGN PATENT DOCUMENTS

| | | | |
|---|---|---|---|
| 117722 | 5/1930 | Austria | 297/184 |
| 522696 | 4/1931 | Fed. Rep. of Germany | 297/184 |
| 2838941 | 3/1980 | Fed. Rep. of Germany | 297/184 |
| 3131166 | 2/1983 | Fed. Rep. of Germany | 297/184 |

OTHER PUBLICATIONS

"Pop-Up Portable Blind" Brochure.

*Primary Examiner*—Robert A. Hafer
*Assistant Examiner*—D. Neal Muir
*Attorney, Agent, or Firm*—Arnold, White & Durkee

[57] ABSTRACT

A lightweight portable blind which includes a quick adjustable combination armrest/shooting rail, roof and roof support members, all of which attach to a folding outdoor chair using clamps. A camouflage slipcover encloses the entire blind so as to conceal the person inside.

12 Claims, 1 Drawing Sheet

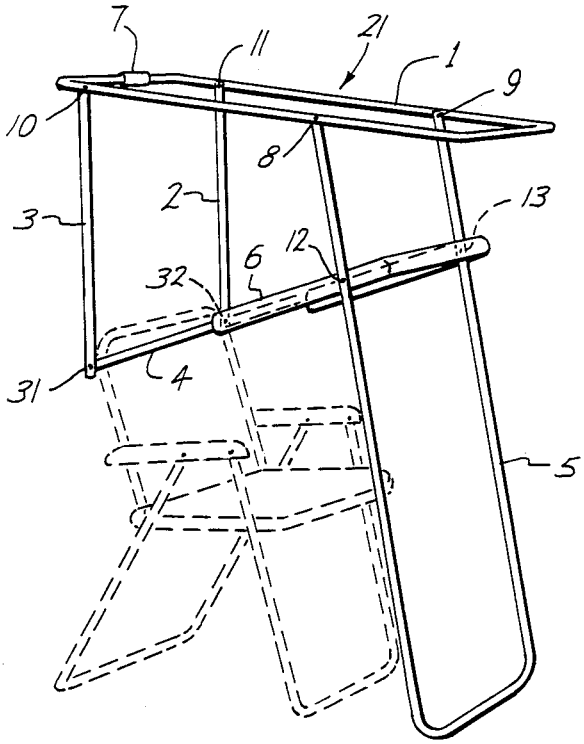
Fig. 1
Fig. 2
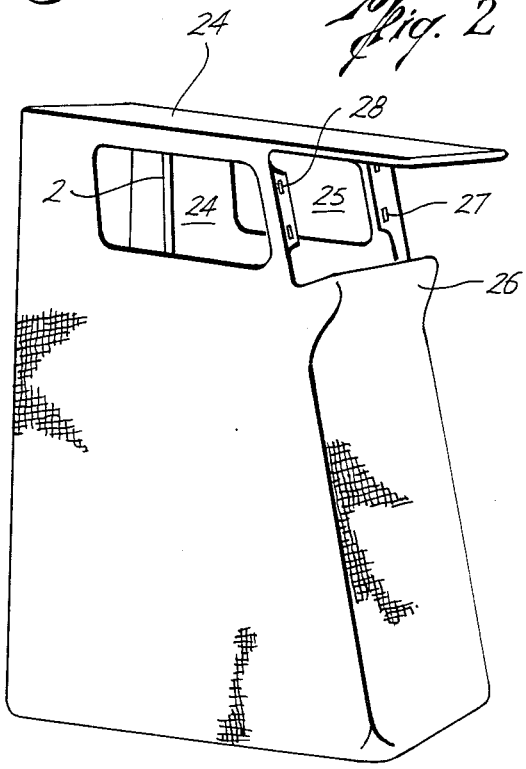
Fig. 3
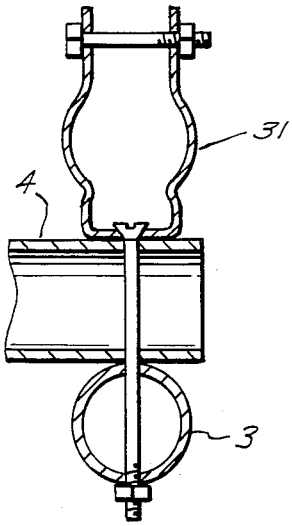

PORTABLE BLIND

BACKGROUND OF THE INVENTION

The invention relates to hunting blinds or blinds used by wildlife observers, photographers, etc. It relates more particularly to portable blinds with a chair, roof and combination armrest/shooting rail.

One of the disadvantages of blinds made up to this time is that they provide no comfortable means of being seated for long periods of time. For example, in most blinds the only seating is a straight bench or a stool with no back support. One of the necessities of hunting or wildlife observation is that the person remain undetected quite often for long periods of time. To do this one must be comfortable as well as concealed.

Another disadvantage of some portable blinds is that they require ropes or other means to secure them to the ground or trees, thus causing an unnecessary waste of time as well as noise that would alarm the game being sought.

One of the largest disadvantages of other blinds is that while they may provide some concealment, they provide no means of supporting a firearm or camera. This is very important as an off-hand shot could cause the hunter to at best miss his quarry entirely, or worse, only injure the game causing undue suffering and pain for the animal because of a misplaced bullet. Also, in photography, in many instances one must have a very steady rest to support one's camera and arms to produce quality pictures.

Another disadvantage of many hunting blinds is that they are either of the permanently fixed type or, if portable, require a considerable amount of time to erect and considerable space for storage and transportation purposes.

SUMMARY

Whereas most blinds do not have comfortable seating, this particular invention is totally unique in that it can readily and easily be attached to a folding lawn chair by means of two clamps that are attached to the frame of the blind. In this way each individual can select the seating that is best suited to their needs.

The ease in which this blind can be set up and entered is outstanding. The frame pivots at the point of attachment to the chair, thus providing fast and quiet entry of the hunter. The camouflage cover is merely slipped over the roof before entering the blind, with no time wasted in securing it with ropes, stakes, etc.

The invention provides a combination armrest/shooting rail that gives extreme accuracy. The fore end of a rifle may be supported at the front while at the same time both elbows are supported at the proper angle, which is slightly lower than where the gun is resting at the front.

The invention provides benchrest-type accuracy that will eliminate any unintentional movement of the firearm or camera. In connection with this, the shooting rail is pivoted on the front support member to provide fast and efficient adjustments in elevation.

Whereas other blinds are considerably larger and heavier or permanently fastened to the earth, this present invention provides a compact, lightweight, foldable frame and a removable camouflage cover that can easily be transported and stored.

BRIEF DESCRIPTION OF THE DRAWINGS

FIG. 1 is a perspective view of the frame of a blind according to a typical embodiment of the present invention.

FIG. 2 is a perspective view of a slipcover according to the typical embodiment of the present invention.

FIG. 3 is a top view of a clamp according to a typical embodiment of the present invention.

DESCRIPTION OF THE PREFERRED EMBODIMENT

Referring to FIG. 1, there is illustrated the blind 21 mainly comprised of a top member serving as the roof 1, the roof supports 2 and 3, a cross member serving as the combination armrest/shooting rail 4, and the support member 5. The roof 1 is a frame constructed in a continuous rectangular loop connected together with the coupling 7. The roof is secured to upper end of the support member 5 and also to the rear roof supports 2 and 3 so as to allow pivoting at their points of attachment. The support member 5 is U-shaped with the bottom of the U being the part of the frame that contacts the ground onto which the blind is erected. At a certain point between the bottom of support member 5 and its top, another U-shaped member, the shooting rail 4, is secured so as to also pivot. The rear of the shooting rail 4 is secured to the bottom of the roof supports 2 and 3 and also to the clamps 31 and 32. The entire frame is secured to the chair, without altering or damaging the chair, using clamps to allow the chair to be used for other purposes during times when not needed for the blind. The height of the shooting rail 4 is adjusted by moving the bottom of the support member 5 either forward or backward. Because of the series of pivot points between all of the members, this movement causes the shooting rail 4 to raise or lower, offering the hunter or photographer exact positioning of their firearm or camera, thus reducing human error to a minimum to accomplish their intended purpose. The only disassembly the blind 21 requires to make it very compact when folded is achieved by removing the securing means 8 and 9 located between the top of the support member 5 and the roof 1. This allows blind 21 to fold in such a way that it can be easily carried and still remain secured to the folding chair. The securing points 10, 11, 12, and 13 are also pivotable. The shooting rail 4 is padded with foam 6 but is not limited to any particular kind of foam. This forms a comfortable, quiet surface on which to rest a camera or firearm and the user's arms at the same time.

Referring to FIG. 2, there is illustrated the slipcover 22. It consists of two pieces of material sewn together. The top piece has the pocket 23 into which the upper forward portion of the roof frame slips. This covers the extended portion of the roof with two layers of material of which one is on top and the other is on bottom. The remainder of the slipcover is pulled over the roof to form a sock that hangs to ground level. The windows 24 and 25 are cut on three sides so as not to remove any material. The excess material is rolled over the roof frame to secure the slipcover to the roof at the window. The front section 26 is constructed of sufficient length to lap over the shooting rail 4. This secures the front section of the slipcover. The slip cover 22 is secured around the support member 5 and is secured above the shooting rail 4 using the hook-and-loop fasteners 27 and 28. After the slipcover has been slipped over the frame, entry to the blind is made by grasping the front of the frame and lifting up the entire frame. When this is done, it causes the frame to pivot at its points of attachment to the chair, whereupon the user may then be seated. Reversing the process provides the user with a quick, easy exit from his comfortable portable blind.

Referring to FIG. 3, there is illustrated a typical clamp 31 used to secure the blind to a standard folding outdoor chair. Also illustrated are the ends of the shooting rail 4 and the rear roof support 3.

I claim:

1. A portable folding blind for use with a flexible slipcover and a chair, the blind comprising:

(a) a roof frame adapted to support a flexible slipcover;

(b) means rotatably attached to and extending downward from the roof frame for rotatably connecting the roof frame to a chair and for supporting the roof frame above such a chair; and (c) rest means positioned below the roof frame and in front of such a chair which may be attached to the chair connecting means for providing a supporting surface in front of such a chair, the rest means being rotatably attached to the connecting means, wherein rotatable attachment of the roof frame, rest means and connecting means accommodates folding of the blind for carrying.

2. The blind of claim 1 wherein the rest means is attached to the chair connecting means so as to allow for height adjustment of the rest means and entry to the blind.

3. The blind of claim 2 wherein the chair connecting means includes:

(a) a rear support member rotatably attached to the roof frame at an attachment point and comprising a means for rotatably clamping the support member to a chair; and (b) a front support member for supporting the roof frame and the rest means on the ground, the front support member being rotatably attached to the roof frame at an attachment point.

4. The blind of claim 3 wherein the rest means is rotatably attached to the rear support member and front support member at attachment points such that the height of the rest means may be adjusted by horizontally displacing the front support member.

5. The blind of claim 4 wherein the clamping means is rotatably attached to the rear support member and the blind is adapted in its folded state to allow a folding chair attached to the blind to be folded together with the blind in a compact manner for carrying.

6. The blind of claim 5 wherein:

(a) the roof frame comprises a generally rectangular member with sides defining an interior space;

(b) the front support member comprises a generally U-shaped member having leg portions and an end portion, the leg portions being rotatably attached to the roof frame;

(c) the rest means comprises a generally U-shaped member having leg portions and an end portion, with the leg portions being rotatably attached to the rear support member and the end portion being rotatably attached to the front support member;

(d) the rear support member comprises a generally U-shaped member having leg portions and an end portion, with the end portion being rotatably attached to the roof frame and the leg portions being rotatably attached to the leg portions of the rest means, the leg portions of the rear support member including a means for rotatably clamping the rear support member to a chair; and (e) the members of the blind are of a size and the modes of attachment of the members are adapted to allow the blind to be collapsed into a compact state for carrying.

7. The blind of claim 4 wherein the roof frame, rest means, front support member and rear support member each comprise a generally rectangular frame member having sides defining an interior space such that the dimensions of the interior spacing and exterior width of each frame member allow the blind to collapse about the attachment points of the frame members into a compact state when at least one of the attachment points is detached.

8. The blind of claim 2 wherein the blind further comprises a chair attached to the roof frame.

9. The blind of claim 8 wherein the chair comprises a foldable chair rotatably attached to the roof frame and adapted to collapse with the blind into a compact state.

10. The blind of claim 3 wherein the blind further comprises a slipcover of flexible material adapted to cover the roof frame, rest means, roof frame attachment means and attached chair in their unfolded state and having openings for observation and hunting.

11. The blind of claim 10 wherein the clamping means is rotatably attached to the rear support member at an attachment point and the slipcover is fitted such that the slipcover restricts the maximum forward displacement of the front support member and such that the blind is pivotable about the attachment point of the clamping means to allow for egress and ingress to the blind without removal of the slipcover.

12. The blind of claim 11 wherein the slipcover further comprises a top section and a side section, with the top section being securable to the roof frame by means of a double layer of material at the forward end of the top section forming an opening adapted for the insertion of the forward portion of the roof frame, with the end of the double layer of material opposite the opening being sealed.

* * * * *